United States Patent [19]

Denny et al.

[11] 4,323,608

[45] Apr. 6, 1982

[54] LABEL

[76] Inventors: Russell W. Denny, 35 Horringer Rd.; Barry D. Denny, 11 Gage Close, both of Bury St. Edmunds, Suffolk, England

[21] Appl. No.: 164,019

[22] Filed: Jun. 30, 1980

[51] Int. Cl.[3] ..... A44C 3/00; G09F 3/00; B65D 65/28

[52] U.S. Cl. ..... 428/43; 40/2 R; 40/310; 40/306; 156/DIG. 10; 156/DIG. 11; 156/DIG. 12; 156/DIG. 13

[58] Field of Search ..... 428/43, 915; 206/604, 206/605, 606, 609, 608, 615; 40/2 R, 21 R, 21 B, 306, 310, 312, 159, 594, 2 G; 156/201, DIG. 10, DIG. 11, DIG. 12, DIG. 13

[56] References Cited

U.S. PATENT DOCUMENTS

| | | | |
|---|---|---|---|
| 1,896,834 | 2/1933 | Brown | 40/306 |
| 2,127,081 | 8/1938 | Brown | 40/306 |
| 2,614,349 | 10/1952 | Barnes | 156/201 |
| 2,706,865 | 4/1955 | Miller | 40/306 |
| 4,104,816 | 8/1978 | Pingeton | 428/41 |

*Primary Examiner*—Edward C. Kimlin
*Assistant Examiner*—L. Falasco
*Attorney, Agent, or Firm*—Wenderoth, Lind & Ponack

[57] ABSTRACT

A form of adhesive label is disclosed which enables instructions, e.g. for the use of the contents of a container to which the label is to be attached, to be detachably secured, with the label, to the container. The label comprises a backing sheet with adhesive on one face protected by a siliconized paper release sheet, and an "instruction" strip glued to its other face. The strip has a first band of adhesive along one transverse edge of its rearward face, a tear line next to the band of adhesive, and a transverse fold line spaced from the tear line and about which the remainder of the strip is folded to lie between the front portion of the strip and the sheet. Adjacent the fold line is a second band of adhesive which with the first band secures the strip to the backing sheet. The remainder of the strip is folded concertina-fashion or otherwise about fold lines so as to lie entirely between the two bands of adhesive. The tear line and a second tear line enable the strip to be detached for study. Printed matter identifying the contents of the container is conveniently provided on both the front portion and the backing sheet so that the front portion can subsequently be torn off and discarded.

9 Claims, 3 Drawing Figures

LINSEED OIL
LINSEED OIL
LINSEED OIL
10
11
12
13
14
15
16
17
18
19
20
21
22

LABEL

BACKGROUND AND SUMMARY OF THE INVENTION

This invention relates to labels and more particularly to labels to be stuck on to cans, bottles, boxes, packets or other articles, and provides a means of attaching instructions or other information detachably to the article.

According to the invention there is provided a label comprising a first portion in the form of a sheet having forward and rear faces whereof the rear face has an adhesive applied thereto, and a second portion formed separately from the first portion and secured thereto by two spaced bands of adhesive. The second portion comprises a strip having one end edge portion secured to the forward face of the first portion by one of the bands of adhesive, a front part extending across the forward face of the first portion from such one band of adhesive, a transverse tear line adjacent and parallel to such one band of adhesive whereby the front part can be detached from the one end edge portion, a fold line at the edge of the front part remote from the tear line, a back part joined to the front part along the fold line and constituting a substantial proportion of the length of the second portion, which back part is disposed between the front part and the first portion, the second of the bands of adhesive securing the back part to said first portion adjacent the fold line and extending parallel to the fold line, a second transverse tear line formed on the back part adjacent and parallel to the second band of adhesive at the side of the second band of adhesive remote from the fold line, whereby tearing of the second portion along the first transverse line enables the back part to be torn along the second tear line.

In use of the label the back part of the label may bear printed instructions pertaining to the care and/or use of the article or, where the article is a container, the use of the contents, and the forward face of the first portion and the front face of the second portion may carry printed matter identifying the article or, as the case may be, its contents. Thus when the label has been torn along the first tear line and then along the second tear line to remove the instructions, the front part may be torn away leaving the identifying matter on the first portion exposed.

BRIEF DESCRIPTION OF THE DRAWINGS

One embodiment of the invention will now be described by way of example with reference to the accompanying diagrammatic drawings in which.

Figures 1, 2, 3:
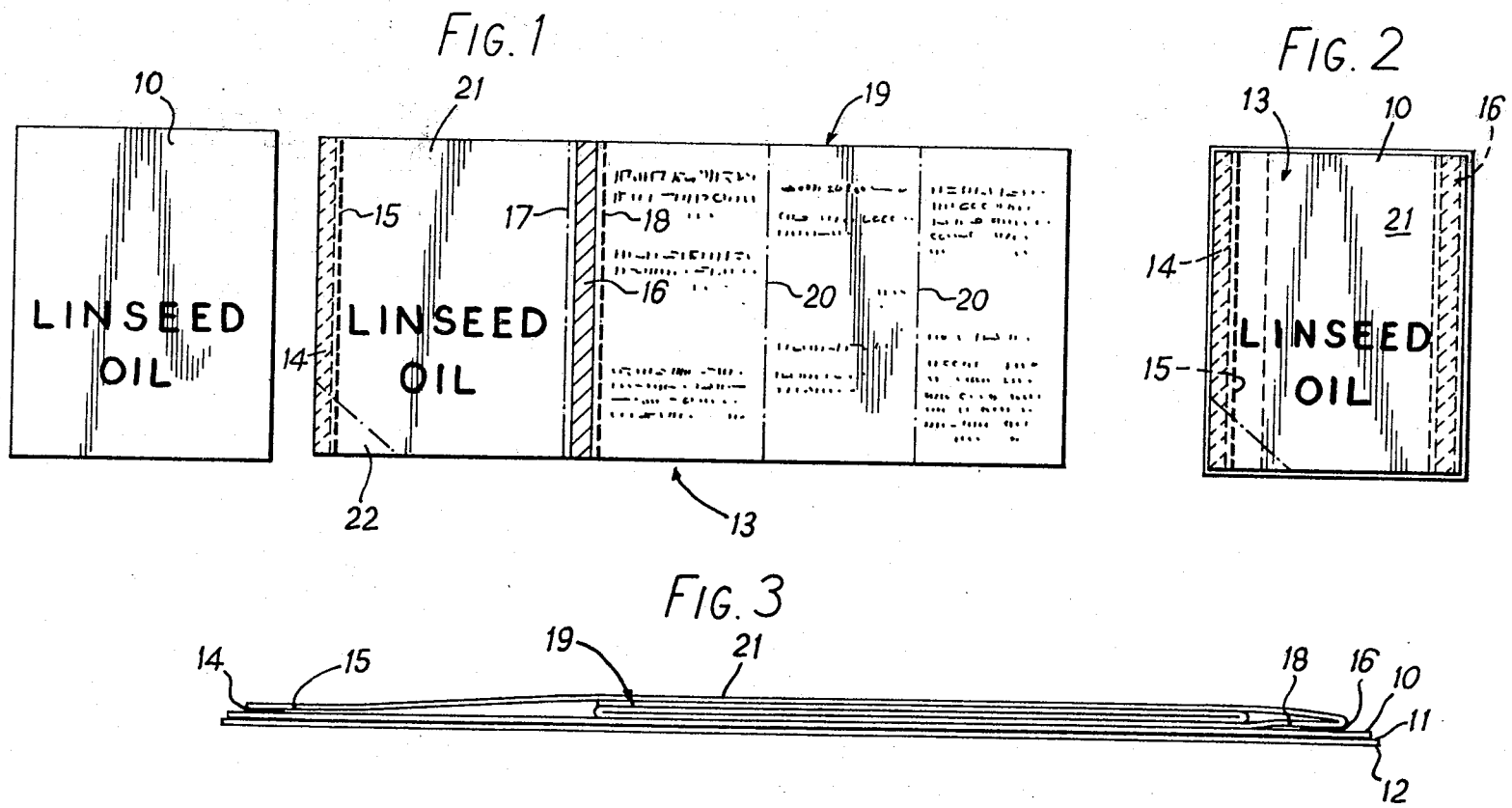
FIG. 1 shows the two portions of the label separately.
FIG. 2 shows the front view of the assembled label.
FIG. 3 is a plan view of the label shown in FIG. 2.

Referring to the drawings, the label comprises a first portion 10 in the form of a sheet of paper with an adhesive 11 on its rear face covered by protective silicone paper 12, and a second portion 13 in the form of a strip of paper. The second portion 13 has on its underface as viewed in FIG. 1 a first band of adhesive 14 extending along one end edge of the strip, and a weakened transverse tear line 15 is formed close to one side of the band. A second transverse band 16 of adhesive spaced away from the first band but parallel thereto is provided on the upper face of the portion 13 and is flanked on opposite sides by a fold line 17 and a second weakened tear line 18, the latter being at the side of band 16 remote from band 14. The remaining right hand end portion 19 of the strip has parallel transverse fold lines 20. Either or both of the tear lines may additionally be indicated by a broken printed line.

To prepare the portion for attachment to portion 10, the right hand portion of the strip is doubled under about fold line 17, and the right hand end portion 19 is folded in concertina fashion along fold lines 20 as shown in FIG. 3 to form the back part of the strip, underlying the front part 21. The spacing of fold lines 20 is such that no part of portion 19 now underlies the adhesive band 14. Both bands of adhesive are now on the underside of the strip and are used to secure the strip to the front face of portion 10.

Printed instructions or other information about the article is provided on the back part 19 of the strip whilst printed identification of the article or its contents and instructions to tear the label along the tear lines to gain access to the information are printed on the front face of the label between the fold line 17 and the tear line 15. The instructions are detached by tearing the label along the tear lines 15 and 18 in that order. Printed lines may be used, to indicate where the label should be torn, instead of the weakened lines formed by intermittent slitting, but the weakened lines are greatly preferred.

When the protective silicone paper sheet has been removed the label is ready for application. When the printed instructions or information have been removed, the front part 21 can be torn away exposing the printed matter on the forward face of the portion 10 so that the article or its contents are still identified.

If desired a portion, e.g. a corner portion 22 of the front part 21 may be cut away to enable pneumatic machinery to be employed to transfer a succession of folded portions 13, with their bands 14, 16 suitably applied or wetted, on to respective sheets 10 positioned side by side on a continuous protective paper strip 12. In this case the portion 19, instead of being folded in concertina fashion, has its third and subsequent panels (counting from the tear line 18) folded so as all to lie between the first and second panels, and all of these panels are preferably folded in the same direction, i.e. in the manner of a flattened spiral. The resulting band of labels can conveniently be used in automatic label-applying mechanisms.

We claim:

1. A label comprising a first portion in the form of a sheet having a forward non-adhesive face and a rear face which has an adhesive applied thereto, and a second portion formed separately from said first portion and secured thereto by two spaced bands of adhesive, said second portion comprising a strip having one end edge portion secured to said forward face of said first portion by one of said bands of adhesive, a front part extending across said forward face of said first portion from said one band of adhesive, a transverse tear line adjacent and parallel to said one band of adhesive whereby said front part can be detached from said one end edge portion, a fold line at the edge of said front part remote from said tear line, a back part joined to said front part along said fold line and constituting a substantial proportion of the length of said second portion, which back part is disposed between said front part and said first portion, the second of said bands of adhesive securing said back part to said first portion adjacent said fold line and extending parallel to said fold line, a second transverse tear line formed in said back part adjacent and parallel to said second band of adhesive at the side of said second band of adhesive remote from said fold line, whereby tearing of said second portion along the first said transverse tear line enables said back part to be torn along said second tear line.

2. A label as claimed in claim 1, wherein said back part carries printed matter.

3. A label as claimed in claim 1, wherein said forward face of said first portion carries printed matter for identifying the contents of a container to which the label is applied.

4. A label as claimed in claim 1, wherein said back part has therein at least one transverse fold line dividing said back part into panels.

5. A label as claimed in claim 1, wherein a portion of said front part is cut away in the region of said first tear line and exposes an area of said back part therebehind.

6. A label as claimed in claim 5, wherein said cutaway portion is a corner area of said front part.

7. A label as claimed in claim 1, wherein said forward face of said first portion bears identifying printed matter.

8. A label as claimed in claim 1, wherein said adhesive on said rear face of said first portion is protected by a release sheet.

9. On an article, a label comprising a first portion in the form of a sheet having a forward non-adhesive face and a rear face which is secured to said article by an adhesive, said forward face bearing printed matter identifying said article or contents of said article, and a second portion formed separately from said first portion and secured thereto by two spaced bands of adhesive, said second portion comprising a strip having one end edge portion secured to said forward face of said first portion by one of said bands of adhesive, a front part extending across said forward face of said first portion from said one band of adhesive, a transverse tear line adjacent and parallel to said one band of adhesive whereby said front part can be detached from said one end edge portion, a fold line at the edge of said front part remote from said tear line, a back part joined to said front part along said fold line and disposed between said front part and said first portion, which back part constitutes a substantial proportion of the length of said second portion and carries printed matter pertaining to use of said article or contents of said article, the second of said bands of adhesive securing said back part to said first portion adjacent said fold line and extending parallel to said fold line, a second transverse tear line formed in said back part adjacent and parallel to said second band of adhesive at the side of said second band of adhesive remote from said fold line, whereby tearing of said second portion along said first transverse tear line enables said back part to be torn along said second tear line.

* * * * *